US010240752B2

(12) United States Patent
Ding

(10) Patent No.: US 10,240,752 B2
(45) Date of Patent: Mar. 26, 2019

(54) NOVELTY SWIVEL ELECTRONIC CANDLE

(71) Applicant: Nantong Yatai Wax Artware Co., Ltd., Nantong, Jiangsu (CN)

(72) Inventor: Yingqi Ding, Jiangsu (CN)

(73) Assignee: Nantong Yatai Wax Artware Co., Ltd., Nantong, Jiangsu (CN)

( * ) Notice: Subject to any disclaimer, the term of this patent is extended or adjusted under 35 U.S.C. 154(b) by 33 days.

(21) Appl. No.: 15/523,423

(22) PCT Filed: Jan. 7, 2016

(86) PCT No.: PCT/CN2016/070353

§ 371 (c)(1),
(2) Date: May 1, 2017

(87) PCT Pub. No.: WO2017/113434

PCT Pub. Date: Jul. 6, 2017

(65) Prior Publication Data

US 2018/0080633 A1 Mar. 22, 2018

(30) Foreign Application Priority Data

Dec. 31, 2015 (CN) ..... 2015 1 1012847

(51) Int. Cl.
*F21S 10/00* (2006.01)
*F21V 14/02* (2006.01)
(Continued)

(52) U.S. Cl.
CPC ..... *F21V 14/02* (2013.01); *F21S 10/00* (2013.01); *F21S 10/04* (2013.01); *F21V 3/00* (2013.01); *F21V 3/062* (2018.02); *F21V 23/002* (2013.01); *F21V 23/005* (2013.01); *F21W 2121/00* (2013.01); *F21Y 2113/13* (2016.08); *F21Y 2115/10* (2016.08)

(58) Field of Classification Search
CPC ..... F21S 10/04; F21V 14/02; F21V 23/002; F21V 23/005; F21V 3/062; F21V 3/0436; F21Y 2113/13; F21Y 2115/10
See application file for complete search history.

(56) References Cited

U.S. PATENT DOCUMENTS 7,252,423 B1 * 8/2007 Wang ..... C11C 5/008 362/392
2004/0004828 A1 * 1/2004 Chernick ..... F21S 10/00 362/35

(Continued)

*Primary Examiner* — Zheng Song
(74) *Attorney, Agent, or Firm* — Rankin, Hill & Clark LLP

(57) ABSTRACT

A novelty swivel electronic candle, includes a base, motor, drive bearing, swivel bracket bar, upper PCB, lower PCB, LED control chip, LED bulb, casing, and wiring. The motor is installed above the base, and the drive bearing is installed above the motor, the swivel bracket bar is vertically installed above the drive bearing. The bar is penetrated through the center of the lower PCB, which is installed above the drive bearing, likewise the bar is also penetrated through the center of the upper PCB, which is installed above the lower PCB. The upper PCB and the swivel bracket bar are fixedly connected together, and the bar is also penetrated through the center of the LED control chip which is installed above the upper PCB. The casing is installed above the base side as a lampshade.

18 Claims, 3 Drawing Sheets

(51) Int. Cl.

| | |
|---|---|
| ***F21S 10/04*** | (2006.01) |
| ***F21V 3/06*** | (2018.01) |
| ***F21V 23/00*** | (2015.01) |
| ***F21V 3/00*** | (2015.01) |
| *F21Y 113/13* | (2016.01) |
| *F21Y 115/10* | (2016.01) |
| *F21W 121/00* | (2006.01) |

(56) References Cited

U.S. PATENT DOCUMENTS

| | | | | |
|---|---|---|---|---|
| 2007/0127249 | A1* | 6/2007 | Medley | A61L 9/03 362/392 |
| 2007/0273547 | A1* | 11/2007 | Lopez Barbarin | F21L 4/04 340/815.42 |
| 2011/0211364 | A1* | 9/2011 | Lutz | A47G 33/06 362/555 |
| 2014/0211499 | A1* | 7/2014 | Fong | F21S 6/001 362/558 |
| 2015/0103520 | A1* | 4/2015 | Fournier | F21V 33/0056 362/190 |
| 2015/0292697 | A1* | 10/2015 | Lai | F21S 10/046 362/286 |
| 2015/0330615 | A1* | 11/2015 | Kim | F21K 9/232 362/382 |
| 2016/0053975 | A1* | 2/2016 | Liao | F21S 10/06 362/249.1 |

* cited by examiner

NOVELTY SWIVEL ELECTRONIC CANDLE

TECHNICAL FIELD

This invention relates to the new decorative lighting, particularly a new swivel electronic candle.

BACKGROUND

The lighting refers to a device that could be pervious to light, and distributing and changing optical source, including all the parts and wares, except the light source, which are needed for fixing and protecting light source as well as the wiring accessories necessary for connection with power supply.

The modern lighting fixture includes home lighting, commercial lighting, industrial lighting, roadway lighting, landscape lighting and special lighting etc. The home lighting is originated from incandescent light bulbs after the electricity came into being. The fluorescent tubes and the efficient light bulb, Halogen lamps, halogen tungsten lamps, gas discharge lamps and special materials lighting like LED etc., were developed one after another, and most of the lighting lamps are developed with these light sources' development, such as from lamp holder to fluorescent tubes and to all kinds of artware lighting.

In the modern lighting fixtures, a type of artware electronic candle is used, generally, the electronic candle is only fixed on a specific base. However, when the bulb inside goes off, the decorative lighting will no longer play its role.

BRIEF DESCRIPTION

To solve the above problem, this invention provides a technical solution includes novel shape, high efficient, multiple power supply to the device, production of a number of colors and even continuous operation without impact to lighting in case a bulb of each color goes off.

A novelty swivel electronic candle includes base, motor, drive bearing, swivel bracket bar, upper PCB, lower PCB, LED control chip, LED bulb, casing and wiring. The said base is a plastic cylinder, and above the base, a motor is installed, on which a drive bearing is installed. The said swivel bracket bar is a round-sectioned metal tube, and the swivel bracket bar is vertically installed above the drive bearing. The upper PCB and the lower PCB are annular, through which the swivel bar is penetrating and the lower PCB is installed above the drive bearing, while the upper PCB is installed above the lower PCB. The upper PCB and swivel bracket bar is fixedly connected. The swivel bracket bar (4) is also penetrating through the LED control chip and is installed above upper PCB. The LED bulb consists of LED bulb A, LED bulb B and LED and bulb C. The LED bulbs A, B and C are installed above LED control chip respectively, and the casing is installed above the base side as a lampshade. The base, motor, drive bearing, upper PCB, lower PCB, LED control chip and LED bulb are all electrically connected by wiring.

As an optimal selection, below the base, a power supply socket is available and the current protector is installed above the base. The power supply socket, current protector are electrically connected with wiring.

As an optimal selection, on the surface of the said lower PCB (6) are installed a number of electric contacts (6*a*) in a circular form, and on the back surface of the upper PCB (5) and the surface of lower PCB (6) a number of conductive circles (5*a*) are furnished to correspond to the annular electric contacts (6*a*).

As an optimal selection, the said LED bulb A, LED bulb B and LED bulb C are of red, green and blue respectively and the two of the same color bulb are grouped in parallel.

As an optimal selection, the drive bearing is fixedly installed on the base by screwing.

As an optimal selection, the said casing is cylindrical, on the side of which hollow pattern is available while on the inner wall of casing, a soft layer of PVC reflecting membrane is furnished.

This invention's beneficial effect is:

(1) This invention provides novel shape, high efficiency, and multiple power supply is provided and a number of colors are produced and even the operation may go on without impact to lighting in case a bulb of each color is put off when the base, motor, drive bearing, swivel bracket bar, upper PCB, lower PCB, LED control chip, LED bulb, casing, wiring are assembled to work together.

(2) This invention, with a power supply socket available below the base and the current protector installed above the base, and the power supply socket, current protector electrically connected with wiring, can ensure multiple power supply to the device and provide the protection to the internal wiring to expand the scope of the use.

(3) This invention, with a number of electric contacts in circular form on the surface of the lower PCB, the back surface of the upper PCB and the surface of lower PCB furnished with a number of conductive circles corresponding to the annular electric contacts, can realize the continuous power supply to the LED control chip while the device is rotating.

(4) This invention, with the said LED bulb A, LED bulb B and LED bulb C being red, green and blue respectively, and the two of the same color bulb grouped in parallel, can ensure the production of multi-colored light when the device is rotating, and cause no impact when a bulb of each color goes off.

(5) This invention, with the drive bearing fixedly installed on the base by screwing, can ensure the stability when the device is rotating during the operation.

(6) This invention, with the said casing furnished with hollow pattern and a soft layer of PVC reflecting membrane on the inner wall of casing, can refract all types of patterns and present 3D effect to increase the application value to effectively improve the ornamental and aesthetics when the internal LED bulb is lighting through soft reflecting PVC membrane. This is the origination in the industry.

DETAILED DESCRIPTION

Practical Method

Figure 1:
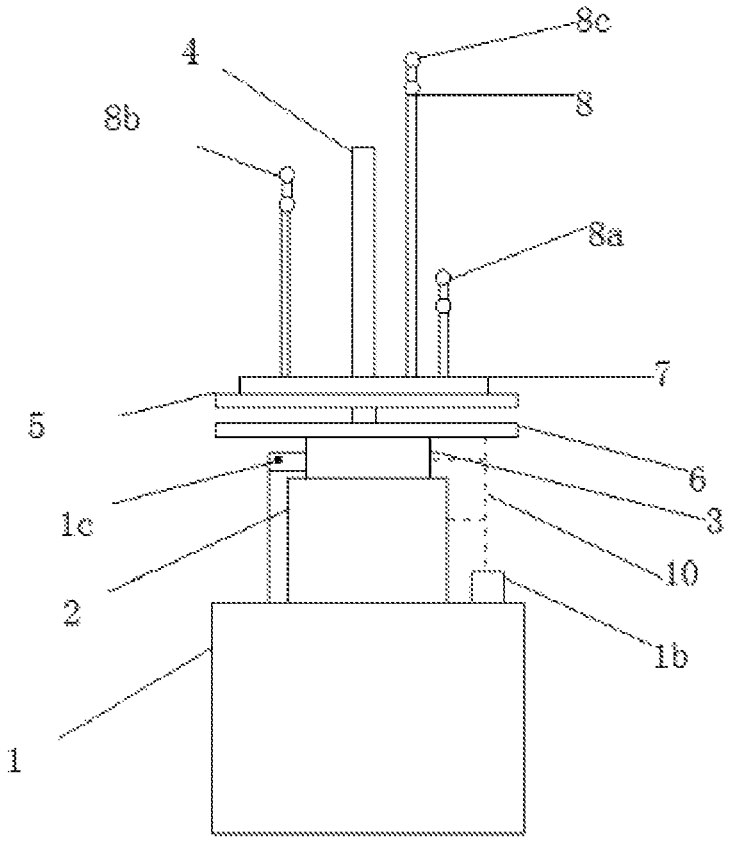
FIG. 1 is a sketch of the internal components structure of the invention.
Figure 2:
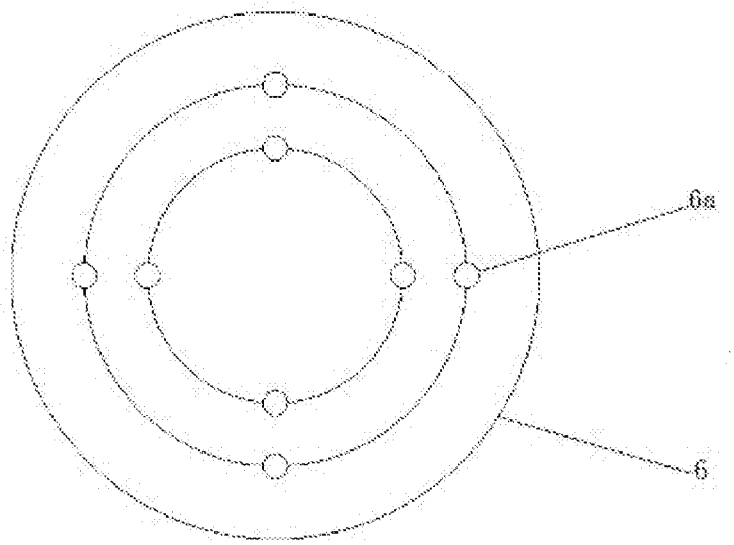
FIG. 2 is a sketch of the lower PCB surface structure of the invention.
Figure 3:
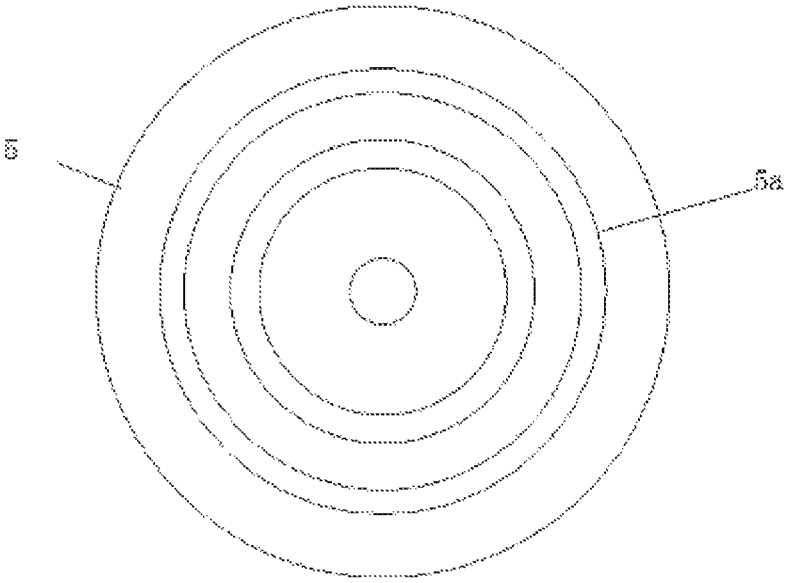
FIG. 3 is a sketch of the back surface of lower PCB structure of the invention.
Figure 4:
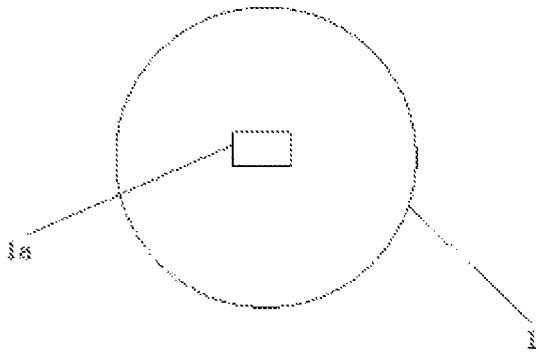
FIG. 4 is a sketch of the base bottom structure of the invention.
Figure 5:
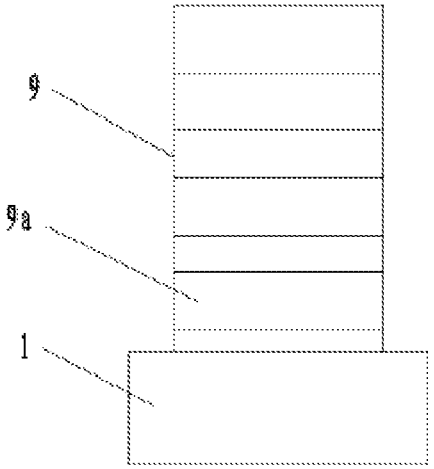
FIG. 5 is a sketch of the external appearance structure of the invention.
Figure 6:
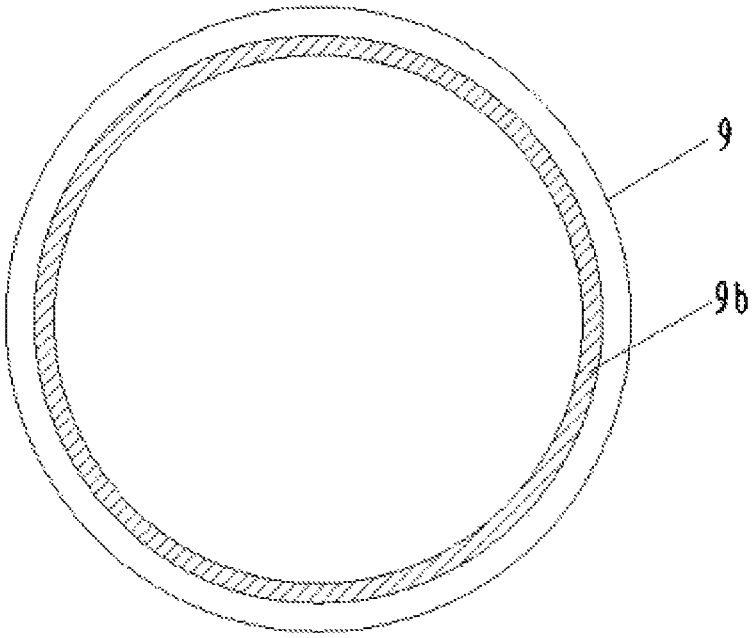
FIG. 6 is a sketch of the casing section of the invention.

In order to make clear the purpose of the invention, the technical scheme and advantages, the detailed method for practice is further described as follows:

As shown in FIGS. 1 through 5, this invention provides a novel swivel electronic candle, which comprises a base 1, a motor 2, a drive bearing 3, a swivel bracket bar 4, an upper PCB 5, a lower PCB board 6, an LED control chip 7, an LED bulb 8, a casing 9 and wiring 10. The said base 1 is a plastic cylinder, and a motor 2 is installed above the base 1, and the drive bearing 3 is arranged above the motor 2.

The said swivel bracket bar 4 is a circular metal tube, and the bar 4 is vertically installed above the drive bearing 3, the upper PCB 5 and the lower PCB 6 are annular, and the swivel bracket bar 4 is penetrating through the lower PCB 6 which is installed above drive bearing 3, while the swivel bracket bar is also penetrating through the upper PCB 5 which is installed above lower PCB 6. The upper PCB 5 and the swivel bracket bar 4 are fixedly connected with each other, and the bar is also penetrating through the center of the LED control chip (7) which is arranged the upper PCB 5. The LED bulb consists of 8 LED bulb A8*a*, LED bulb B8*b* and LED bulb C8*c*, and the LED bulb A8*a*, LED bulb B8*b* and LED bulb C8*c* are mounted above the LED control chip 7, and the casing 9, as the lampshade, is arranged above the outer side of the base 1. The base 1, motor 2, drive bearing 3, upper PCB 5, lower PCB 6, LED control chip 7, LED bulb 8 are connected by wiring 10.

As shown above, the invention is provided with a power jack 1*a* below the base 1, and a current protector 1*b* is arranged above the base 1. The power supply jack 1*a* and current protector 1*b* are connecting with wiring 10 to ensure the multiple power supply to the device and protection for the internal circuit and expand the scope of the use.

Furthermore, on the surface of the said lower PCB 6 are installed a number of electric contacts 6*a* in a circular form, and on the back surface of the upper PCB 5 and the surface of lower PCB 6 a number of conductive circles 5*a* corresponding to the annular electric contacts (6*a*) are furnished to realize the continuous supply to LED control chip 7 while the device is rotating.

In addition, the LED bulb A8*a*, LED bulb B8*b* and LED bulb C8*c* were are, green, blue, two bulbs of the same color are grouped to ensure production of colorful lights while the device is rotating and even the device can continue the operation in case one bulb of each color goes off.

In addition, the drive bearing 3 is fixedly installed on the base 1 by screw 1*c* to ensure the stability during the rotation of the device.

Lastly, the casing 9 is cylindrical and the side surface of the casing is provided with hollow pattern 9*a*, and the inner wall of the cover shell 9 is furnished with a layer of PVC soft reflective membrane 9B. Under the internal LED bulb's light, different kinds of patterns are refracted through the PVC soft reflective membrane 9*b* to present 3D effect, which intensifies the practical value of the invention and effectively improve the ornamental and aesthetics of this electronic candle, which is the origination in the industry.

The above practical examples are only relatively optimal, but not the limits of this invention's technical scheme. Any technical practice based on the above examples without creative efforts shall fall into the protection scope of this invention patent.

The invention claimed is:

1. A novelty swivel electronic candle, comprising: a base; a motor; a drive bearing; a swivel bracket bar; an upper PCB; a lower PCB; an LED control chip; LED bulbs; a casing; and wirings wherein said base is a plastic cylinder, and above the base, the motor is installed, above which the drive bearing is installed, and wherein said swivel bracket bar is a round-sectioned metal tube, and the swivel bracket bar is vertically installed above the drive bearing, wherein the upper PCB and the lower PCB are annular, through which the swivel bracket bar is penetrating through and the lower PCB is installed above the drive bearing, while the upper PCB is installed above the lower PCB, and the upper PCB and the swivel bracket bar are fixedly connected to each other, and the swivel bracket bar is also penetrating through the LED control chip and is installed above the upper PCB, and wherein the LED bulbs consist of an LED bulb A, an LED bulb B and an LED bulb C with the LED bulbs A, B and C being installed above the LED control chip respectively, the casing is installed above the base side as a lampshade, and the base, the motor, the drive bearing, the upper PCB, the lower PCB, the LED control chip, and the LED bulb are all electrically connected by the wirings.

2. The novelty swivel electronic candle as described in claim 1 wherein: below the base, a power supply socket is available and a current protector is installed above the base wherein the power supply socket and the current protector are electrically connected with the wirings.

3. The novelty swivel electronic candle as described in claim 2 wherein:

the LED bulb A, the LED bulb B and the LED bulb C are red, green and blue respectively.

4. The novelty swivel electronic candle as described in claim 3 wherein: the casing is cylindrical, on an inner side of which a hollow pattern is provided while on the inner wall of the casing a soft layer of PVC reflecting membrane is furnished.

5. The novelty swivel electronic candle as described in claim 4 wherein the swivel bracket bar is not electrically connected to the upper PCB or lower PCB.

6. The novelty swivel electronic candle as described in claim 5 wherein the swivel bracket bar is coaxial with the motor.

7. The novelty swivel electronic candle as described in claim 1 wherein: on a surface of the lower PCB are a number of electric contacts in a circular form, and on a back surface of the upper PCB and the surface of lower PCB are a number of conductive circles that are arranged to correspond to the annular electric contacts.

8. The novelty swivel electronic candle as described in claim 1 wherein: the LED bulb A, the LED bulb B and the LED bulb C are red, green and blue respectively.

9. The novelty swivel electronic candle as described in claim 1 wherein: the drive bearing is fixedly installed on the base by screwing.

10. The novelty swivel electronic candle as described in claim 1 wherein: the casing is cylindrical, on an inner side of which a hollow pattern is provided while on the inner wall of the casing a soft layer of PVC reflecting membrane is furnished.

11. The novelty swivel electronic candle as described in claim 1 wherein the swivel bracket bar is not electrically connected to the upper PCB or lower PCB.

12. The novelty swivel electronic candle as described in claim 11 wherein the swivel bracket bar is coaxial with the motor.

13. The novelty swivel electronic candle as described in claim 1 wherein the swivel bracket bar is coaxial with the motor.

14. The novelty swivel electronic candle as described in claim 1 wherein the motor drives rotation of the swivel bracket bar via the drive bearing and rotation of the swivel bar bracket rotates the upper PCB via the fixed connection between the upper PCB and the swivel bar bracket, and rotation of the upper PCB rotates the LED control chip mounted thereon and rotates the LED bulbs which are mounted to the LED control chip.

15. A novelty swivel electronic candle, comprising: a cylindrical base; a motor; a drive bearing; a swivel bracket bar; an upper PCB; a lower PCB; an LED control chip; LED bulbs; a casing; and wirings, wherein the motor is disposed above the cylindrical base and the drive bearing is disposed above the motor, wherein the motor drivingly rotates the swivel bracket bar via the drive bearing, wherein the swivel bracket bar is vertically disposed above the drive bearing, wherein the upper PCB and the lower PCB are annular and both have the swivel bracket bar extending therethrough, the lower PCB is disposed above the drive bearing and the upper PCB is disposed above the lower PCB, wherein the upper PCB and the swivel bracket bar are fixedly connected to one another, and the swivel bracket bar extends through the LED control chip that is mounted on the upper PCB, and further wherein the LED bulbs include at least three LED bulbs disposed above the LED control chip, and the casing is disposed above the base as a lampshade, and the base, the motor, the drive bearing, the upper PCB, the lower PCB, the LED control chip, and the LED bulb are all electrically connected by the wirings.

16. The novelty swivel electronic candle as described in claim 15 wherein the swivel bracket bar is not electrically connected to the upper PCB or lower PCB.

17. The novelty swivel electronic candle as described in claim 16 wherein the swivel bracket bar is coaxial with the motor.

18. The novelty swivel electronic candle as described in claim 15 wherein the swivel bracket bar is coaxial with the motor.

* * * * *